US005449173A

United States Patent [19]

Thomas et al.

[11] Patent Number: 5,449,173

[45] Date of Patent: Sep. 12, 1995

[54] REEL-TYPE SLOT MACHINE WITH SUPPLEMENTAL PAYOFF

[75] Inventors: Alfred Thomas; William A. Gwiasda, both of Chicago, Ill.

[73] Assignee: WMS Gaming Inc., Chicago, Ill.

[21] Appl. No.: 311,863

[22] Filed: Sep. 26, 1994

[51] Int. Cl.[6] ..... G07F 17/34

[52] U.S. Cl. ..... 273/143 R

[58] Field of Search ..... 273/143 R, 138 A, 85 CP

[56] References Cited

U.S. PATENT DOCUMENTS 4,721,307 1/1988 Okada ..... 273/143 R 5,251,898 10/1993 Dickenson et al. ..... 273/143 R

FOREIGN PATENT DOCUMENTS 2033638 5/1980 United Kingdom ..... 273/143 R 2098777 11/1982 United Kingdom ..... 273/143 R

*Primary Examiner*—Benjamin H. Layno

*Attorney, Agent, or Firm*—Rockey, Rifkin and Ryther

[57] ABSTRACT

According to the present invention, a wildcard symbol is provided at a stop position of one of the reels in a typical reel-type slot machine. In addition to the usual spin and payoff cycle of such a machine, the appearance of the wildcard on the pay line is used to trigger a supplemental pay off under certain circumstances. During the supplemental pay off sequence, the reel on which the wild symbol appears is caused to shake or jitter while coins fall into the trough as if money were being shaken off a tree.

1 Claim, 2 Drawing Sheets

| REEL STRIPS | | | | |
|---|---|---|---|---|
| STOPS | REEL 16 | REEL 18 | REEL 20 | |
| 1 | SEVEN | SEVEN | SEVEN | |
| 2 | BLANK | BLANK | BLANK | |
| 3 | 1BAR | 1BAR | 1BAR | |
| 4 | BLANK | BLANK | BLANK | |
| 5 | 3BAR | 3BAR | 3BAR | |
| 6 | BLANK | BLANK | BLANK | |
| 7 | 2BAR | 2BAR | 2BAR | |
| 8 | BLANK | BLANK | BLANK | |
| 9 | 1BAR | 1BAR | 1BAR | |
| 10 | BLANK | BLANK | BLANK | |
| 11 | 2BAR | 2BAR | 2BAR | |
| 12 | BLANK | BLANK | BLANK | |
| 13 | CHERRY | CHERRY | CHERRY | |
| 14 | BLANK | BLANK | BLANK | |
| 15 | 3BAR | 3BAR | 3BAR | |
| 16 | BLANK | BLANK | BLANK | |
| 17 | 1BAR | 1 BAR | WILD | |
| 18 | BLANK | BLANK | BLANK | |
| | | | | |
| | | | | |

REEL-TYPE SLOT MACHINE WITH SUPPLEMENTAL PAYOFF

BACKGROUND AND SUMMARY OF THE INVENTION

The present invention generally relates to gaming apparatus and, more particularly, to electronic reel-type slot machines having a plurality of reels rotatable about a common axis. In a typical reel-type slot machine, a payoff is made to a player when a winning set of symbols is displayed on the pay line(s) of the machine. To start play, a button is pushed or a handle is pulled to initiate rotation of the reels.

In one type of design, the angular positions of the reels, after they have been stopped, is detected and the appropriate payoff amount, if any, is calculated and paid to the player. Another approach in modern machines uses random number generation to select the symbols to be displayed on the pay line(s). The payoff is determined based on a pay table which contains payoff amounts for the various symbol combinations.

In order to stimulate player interest in such machines, it is desirable to add additional features and novelties to provide entertainment by incorporating different strategies and features which attract player interest. Through the use of a microprocessor based controller system including a stepper motor for positioning the reels it is possible to provide simulations and features that are somewhat unusual and interesting to the players.

According to the present invention and in addition to the usual spin and payoff cycle of a slot machine, there is provided a wildcard symbol on one of the reels. Its appearance on the pay line is used to trigger a supplemental pay off under certain circumstances. During the supplemental pay off sequence, the reel on which the wild symbol appears is caused to shake or jitter while coins fall into the trough as if money were being shaken off a tree.

DETAILED DESCRIPTION OF THE INVENTION

Figures 1, 2:
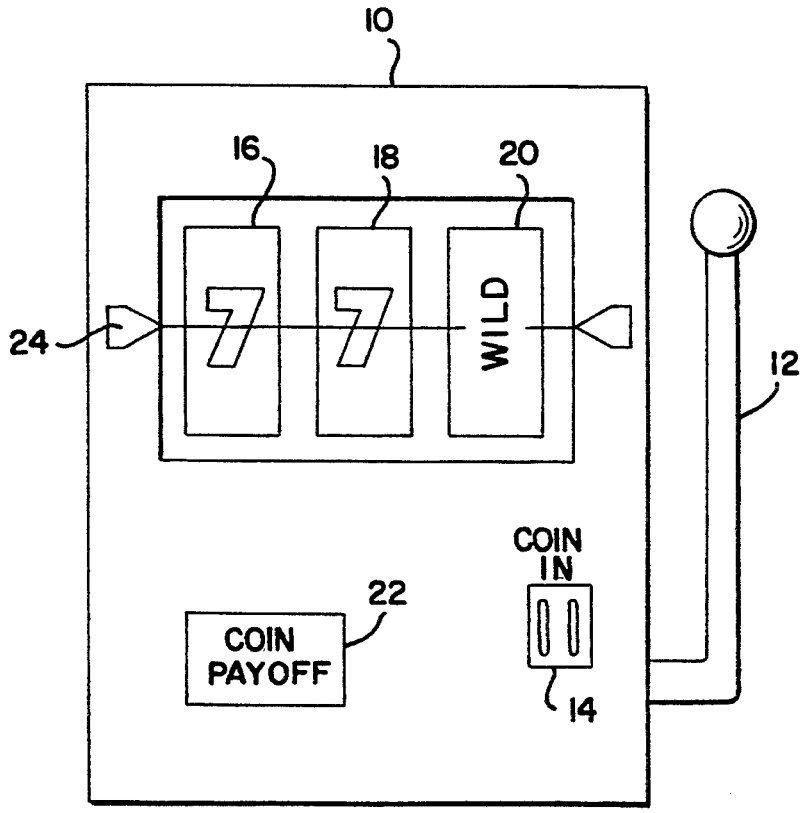
FIG. 1 shows a typical electronic reel-type slot machine which may incorporate the present invention.
FIG. 2 illustrates one example of three reel "strips" containing symbols positioned at the stop positions.

Referring to FIG. 1, an electronic reel-type slot machine 10 is illustrated. Slot machine 10 includes a handle 12, a coin slot 14, payout trough 22, credits display (not shown) and reels, each having a plurality of stop positions thereon. Each reel includes a system of symbols which are used to display an outcome of a game which is played on slot machine 10. In the illustrated embodiment, slot machine 10 includes three slot reels 16, 18 and 20, each of which has eighteen stop positions which correspond to symbols. The symbols form combinations which correspond to a pay table displayed to the player.

In practice, slot machine 10 can incorporate any number of reels and the reels may include any reasonable number of stop positions. Any system of symbols can be utilized as long as there is one symbol, which may include a "blank" symbol, corresponding to each stop position on each reel. When a coin is inserted or credits are present, the game start button and/or handle is enabled. By pushing the start button or pulling the handle, the player causes the microprocessor control system to spin the reels in an attempt to win money if a winning set of symbols is selected and displayed on the pay line 24.

FIG. 2 illustrates an example of three reel "strips" which are secured to reels 16–20. Each of the reel strips contain a system of symbols and, in this example, has eighteen discrete physical stop positions at which a symbol is displayed. It should be noted that duplicate symbols can be employed on each reel. Note that one of the symbols on the third reel strip is a "wild" symbol that can be substituted for any winning symbol if the other two reels display part of a winning combination. For example, a win is achieved by obtaining two sevens and the "wild" symbol.

Figure 3:
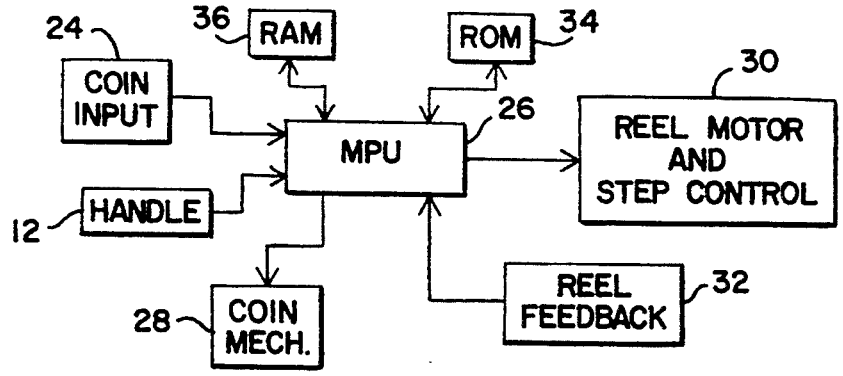
FIG. 3 is a block diagram of a control system for the present invention.

FIG. 3 is a block diagram of a control system suitable for practicing the present invention. Coin detector 24 sends a signal to microprocessor 26 when a coin is inserted into coin slot 14. Upon closing a player operated switch, the microprocessor spins the reels and randomly selects the symbols to be displayed on the pay line. If a player wins, the microprocessor 26 signals the coin mechanism 28 to dispense a payoff to the player via coin payout trough 22 or increments a credits display.

Reel motor and step controller 30 rotates the reels 16–20 in response to signals from microprocessor 26. The signals are generated after a coin or credit input and player operation of the switch handle 12. Controller 30 stops the reels at positions determined by the microprocessor such that the reels display three symbols on the pay line 22. To ensure that the correct reel stop combination is displayed, detector 32 provides feedback signals to microprocessor 26 representative of the rotational position of each reel relative to pay line 22. Feedback of this type is utilized in accordance with known techniques in this art.

In the preferred embodiment of the present invention, the wild symbol on reel 20 not only enables the player to receive a payout according to the pay table for the winning symbol combination on reels 16 and 18, it also allows the player to experience a supplemental payout routine according to the present invention. The supplemental payout takes place after the regular payout which may be in coins or credits. The supplemental payout is always in coins which are disbursed during a payout cycle following the regular payout cycle.

During the supplemental payout cycle the reel containing the wild symbol, in the illustrated embodiment reel 20, is caused to vibrate back and forth about its position on the pay line 24 to provide interest and to indicate the reason for the coin payout. This is a highly desirable feature as players much prefer to experience a coin payoff than to simply see credits being accumulated on a digital display.

Figure 4:
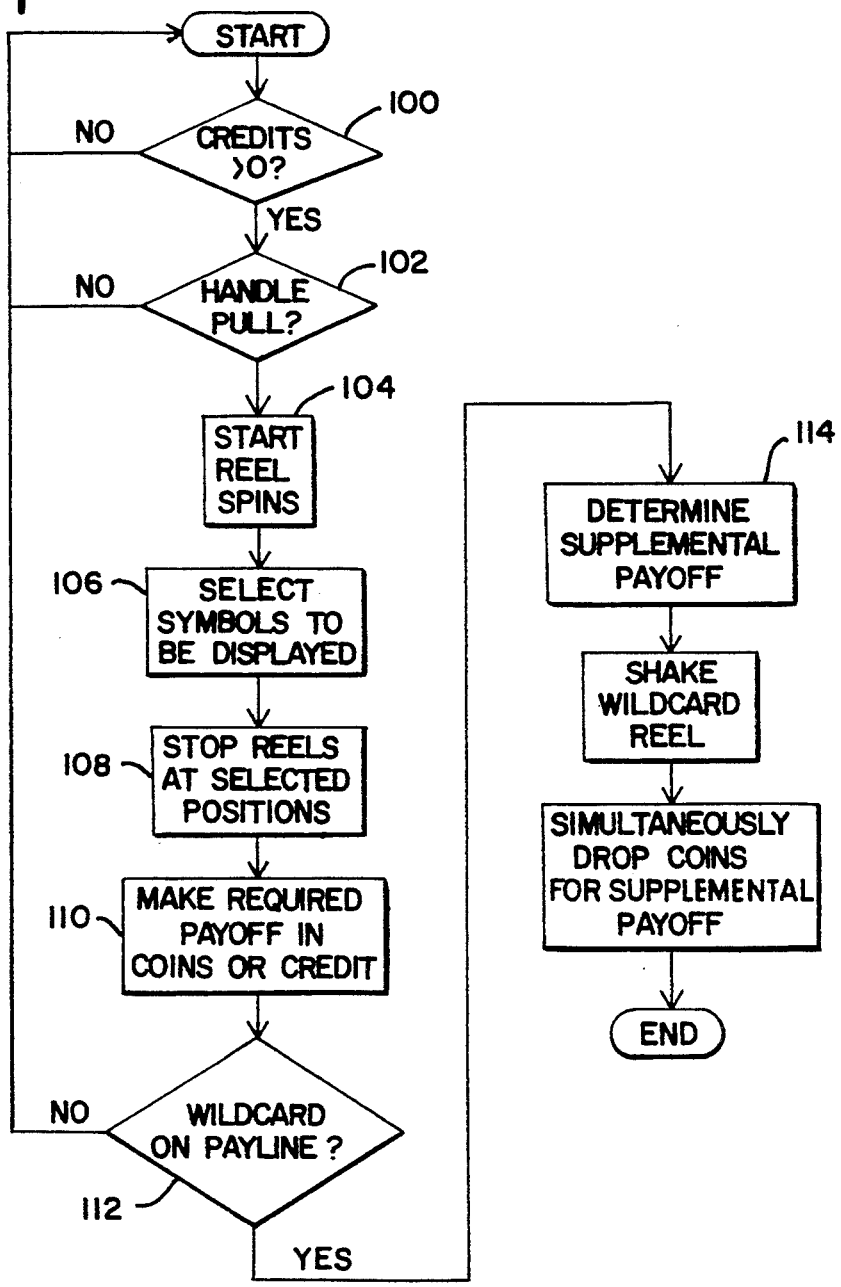
FIG. 4 is a flow diagram of the computer program according to the invention.

The manner in which the system according to the invention provides the supplemental payout is described in connection with FIG. 4. FIG. 4 is a computer flow diagram illustrating the manner in which the microprocessor is controlled to provide the features according to the invention. From the flow diagram of FIG. 4, those skilled in this art will appreciate how to program any given processor system to perform the invention disclosed herein.

With reference-to FIG. 4, the system first checks to see if the player has any credits, i.e. if coins have been inserted or won, step 100. If the credits are greater than zero, the microprocessor 26 checks to see if the switch handle has been operated by the player, step 102. In the event that coins have been inserted or credits are available and the player operated switch has been actuated, microprocessor 26 starts the reel spinning process by operating the reel motor and step control 30, step 104. The microprocessor, using commonly known random number selection techniques, then selects the symbols to be displayed on the pay line 24 for each of the reel strips 16, 18, and 20. Although the random number selection of these symbols forms no part of present invention, additional information concerning implementation of such routines may be found in U.S. Pat. No. 4,095,795 and in co-pending patents applications Ser. Nos. 08/254,786 and 08/246,791 hereby incorporated by reference.

After the symbols are randomly selected, step 106, a reel timing process is initiated after which the reels are stopped at the position selected, step 108. The program then determines if the selected symbols correspond to winning combinations as set forth on the pay table associated with the machine, step 110, and makes any required payout in either coins or credits depending on the payout mode selected by the player. For example, in the coin mode, five coins are dropped in the payout chute if the player has won a five coin payout. Alternatively, in the credit mode, five credits are awarded and the digital display is incremented by that amount to indicate the award. In that case, no coins are dispensed directly to the player.

According to the present invention, the system then checks to determine whether the wild symbol contained at position 17 on reel 20 has been selected for display on the pay line 24, step 112. If not, then one cycle of game play is complete and the program branches back to the start. If the wild symbol is displayed on the pay line, then the microprocessor continues and determines the amount of a supplemental payout over and above any payout disclosed on the pay table of the machine, step 114.

The amount of the supplemental payout is selected using a random number generation process, a typical example of which is set forth hereafter. The random number generator is directed to select a number between 1 and 724. Based on the number selected, a payout table, stored in the ROM memory 34 (FIG. 3), is consulted to determine how many additional coins are to be paid out. A typical payout table is:

| Random Number | Coin Payout |
|---|---|
| 1 | 100 |
| 2–4 | 50 |

-continued

| Random Number | Coin Payout |
|---|---|
| 5–8 | 20 |
| 9–420 | 5 |
| 421–618 | 2 |
| 619–724 | 1 |

After determining the amount of the payout, the microprocessor initiates a payoff routine for the supplemental payout. The routine includes two processes which take place simultaneously. To enhance game appeal, during the supplemental payout, the reel containing the wild symbol (for example a fanciful image of a jitter bug) is caused to shake back and forth by controlling the stepper motor for that reel to move it slightly off center, back to center and slightly off center in the other direction for a number of cycles. Thus, the player views a simulation of the jitterbug shaking back and forth during the supplemental payout cycle.

During the shaking simulation, the number of coins determined by the random number generator for the supplemental payout are dispensed to the payout trough. It should be noted that coins are paid out regardless whether the machine is in the coin or credit mode. Thus, players always receive coins for the supplemental payout adding a certain excitement to a game particularly when the game is otherwise being played in the credit mode.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected.

What is claimed is:

1. A method of making a supplemental payoff in a reel-type slot machine having a plurality of reels rotatable through a fixed number of stop positions at which viewable symbols are provided for display on a pay line, a wildcard symbol being provided at at least one of the stop positions of one reel, the method comprising the steps of:

a) displaying a randomly selected set of symbols on the pay line;

b) making a payoff to the player if a winning coincidence of symbols is obtained;

c) determining if the wildcard symbol is displayed on the pay line;

d) making a randomly selected supplemental payoff to the player if the wildcard symbol is displayed on the pay line; and e) vibrating the reel containing the wildcard symbol back and forth while making the supplemental payoff by moving the wildcard symbol slightly off center, back to center and slightly off center in the other direction.

* * * * *